US006273758B1

(12) United States Patent
Lloyd et al.

(10) Patent No.: US 6,273,758 B1
(45) Date of Patent: Aug. 14, 2001

(54) WAFER CONNECTOR WITH IMPROVED GROUNDING SHIELD

(75) Inventors: Keith Lloyd, Maumelle, AR (US); Michael F. Magajne, Cicero, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/575,096

(22) Filed: May 19, 2000

(51) Int. Cl.[7] ..... H01R 13/58
(52) U.S. Cl. ..... 439/607
(58) Field of Search ..... 439/607–610, 439/497, 325, 327, 329, 345, 347, 783, 736, 737, 863, 493, 494, 495, 496, 499, 701

(56) References Cited

U.S. PATENT DOCUMENTS

| | | | | |
|---|---|---|---|---|
| 4,615,578 | | 10/1986 | Stadler et al. . | |
| 5,176,538 | | 1/1993 | Hansell, III et al. | 439/607 |
| 5,586,911 | * | 12/1996 | Miller et al. | 439/607 |
| 5,975,955 | * | 11/1999 | Bogiel et al. | 439/607 |
| 5,993,259 | | 11/1999 | Stokoe et al. | 439/608 |
| 6,017,245 | * | 1/2000 | Karir | 439/610 |
| 6,066,000 | * | 5/2000 | Masumoto et al. | 439/607 |
| 6,095,863 | * | 8/2000 | Tung | 439/607 |
| 6,115,257 | * | 5/2000 | Laity | 361/737 |

* cited by examiner

*Primary Examiner*—Brian Sircus
*Assistant Examiner*—J. F. Duverne
(74) *Attorney, Agent, or Firm*—A. A. Tirva

(57) ABSTRACT

An electrical connector module is provided having a housing with a receptacle. Conductive contacts are located within the receptacle and a grounding shield is provided that partially defines the top of the connector housing. A depression is formed in the grounding shield and extends into abutting contact with one of the terminals held in the connector housing to effectuate an electrical connection therebetween.

19 Claims, 3 Drawing Sheets

WAFER CONNECTOR WITH IMPROVED GROUNDING SHIELD

BACKGROUND OF THE INVENTION

The present invention relates generally to connectors used in multiple-unit connector assemblies, and more particularly to an improved grounding shield for use with wafer connectors.

In the field of telecommunications and in other electronic fields, cable assemblies are used to connect one electronic device to another. In many instances, the cable assemblies have at one or more of their ends, a plurality of connector modules, each of which serves to connect a plurality of individual wires to an opposing connector, such as a pin connector. It is desirable to provide very high density pin counts while maintaining superior cross-talk performance. Proper selective grounding of certain terminals is required to provide increased data transfer.

Structures for attaining these aims are known in the art, but tend to be bulky and require additional, valuable, empty unused area. Such structures are shown in U.S. Pat. No. 5,176,538, issued Jan. 5, 1993, in which a connector has a plurality of slots and cavities with signal contacts being received within the cavities of the connector. A grounding shield is provided having a plurality of contacts in the form of spring fingers which are positioned to protrude into the unoccupied slots. These spring fingers serve as contact portions that contact selected terminal pins. In this construction, each connector has to be custom configured for each installation.

The present invention is therefore directed to a novel and unique grounding shield for use with connector modules, such as wafer connectors, that efficiently maximizes pin counts and which is simple and inexpensive to make and use.

SUMMARY OF THE INVENTION

Accordingly, it is a general object of the present invention to provide an improved grounding shield for use with wafer connector modules which has a simple standard construction, and permits ease of assembly.

Another object of the present invention is to provide a grounding shield for use with wafer connectors which does not increase the connector size or result in a decrease of pin density in an opposing connector.

Yet another object of the present invention is to provide a grounding shield of singular modular configuration which is variable to accommodate as many grounding paths as desired.

A still further object of the present invention is to provide a grounding shield having at least one depression formed therein that extends into contact with a selected terminal of the connector to define a ground path without modifying the configuration of the connector.

The present invention accomplishes these and other objects by way of its unique structure.

In accordance with one principal aspect of the present invention, a connector is provided with an insulative housing with a defined body portion, the body portion including a receptacle defined therein that accommodates a plurality of conductive terminals, each of which has a contact assembly for contacting a conductive pin of an opposing connector. A conductive grounding shield is provided that fits on the connector housing body portion and serves to at least partially enclose the terminals in the receptacle. The grounding shield has at least one contact portion disposed thereon that takes the form of a depression that may be drawn in the grounding shield. The depression extends into electrical contact with a selected, opposing terminal in the connector receptacle. The depression may be permanently and conductively joined to the one terminal.

The connector may include a nonconductive insert disposed within the receptacle portion thereof. This insert encloses and may separate the terminals from each other and further define a series of openings into the connector receptacle that permit the passage of conductive pins from the opposing connector to enter the connector and engage the terminals thereof. The insert may include one or more apertures formed in a top wall thereof and aligned with the terminals so that the depression may extend through the aperture and into contact with its corresponding terminal. The grounding shield has a large cover portion that serves to partially define a face of the connector.

In another principal aspect of the present invention the connector housing body has a general U-shaped configuration that defines the receptacle thereof, with the housing having a base wall and a pair of parallel sidewalls that extend along opposing longitudinal edges of the housing. Each of the terminals of the connector has a flat body portion that is disposed between its contact portion and the tail portion. The grounding shield may be considered as overlying the terminals and closing off a top of the receptacle. The grounding shield may similarly include a flat top wall and two sidewalls, with the top wall of the shield having a dish formed therein by drawing so that a portion thereof extends away from the shield top wall in opposition to and into contact with one of the terminal body portions. The dish portion may be connected to the terminal body portion by a resistance weld.

In another principal aspect of the present invention, a nonconductive insert, preferably formed from a dielectric material, is provided for insertion in the receptacle. This insert supports the terminals and also supports the grounding shield. The insert has a series of openings formed in a front face thereof that defines passages for conductive pins of the opposing connector to enter and engage the terminals of the connector. The dish portion extends through one of the insert apertures to effectuate its contact with the terminal body portion.

In yet another principal aspect, the present invention incudes an electrical connector module having an insulative body portion with a series of conductive terminals disposed within the body portion. The connector has a grounding shield which lies upon the outer surface of the body portion and which includes a cover portion that extends in a first plane. The grounding shield has at least one depression formed therein that extends away from the cover portion thereof and into opposition with a selected one of the connector terminals. This depression includes a contact portion spaced away from the grounding shield cover portion that is supported in its extent by a portion of the grounding shield that is also drawn during the forming process. In the preferred embodiment, the depression contact portion or a tip thereof, extends within a second plane, different from and generally parallel to the first plane so that the grounding shield contact portion may easily abut one of the connector terminals. A dielectric insert is provided having one or more apertures formed therein that provide passages through which the depressions extent in their path of ground contact to selected terminals. The contact portions of the grounding shield are preferably joined to their corresponding opposing terminals, such as by resistance welding or the like.

These and other objects, features and advantages of the present invention will be clearly understood through consideration of the following detailed description.

BRIEF DESCRIPTION OF THE DRAWINGS

In the course of the following detailed description, reference will be made to the accompanying drawings in which.

DETAILED DESCRIPTION OF THE DRAWINGS

Figure 1:
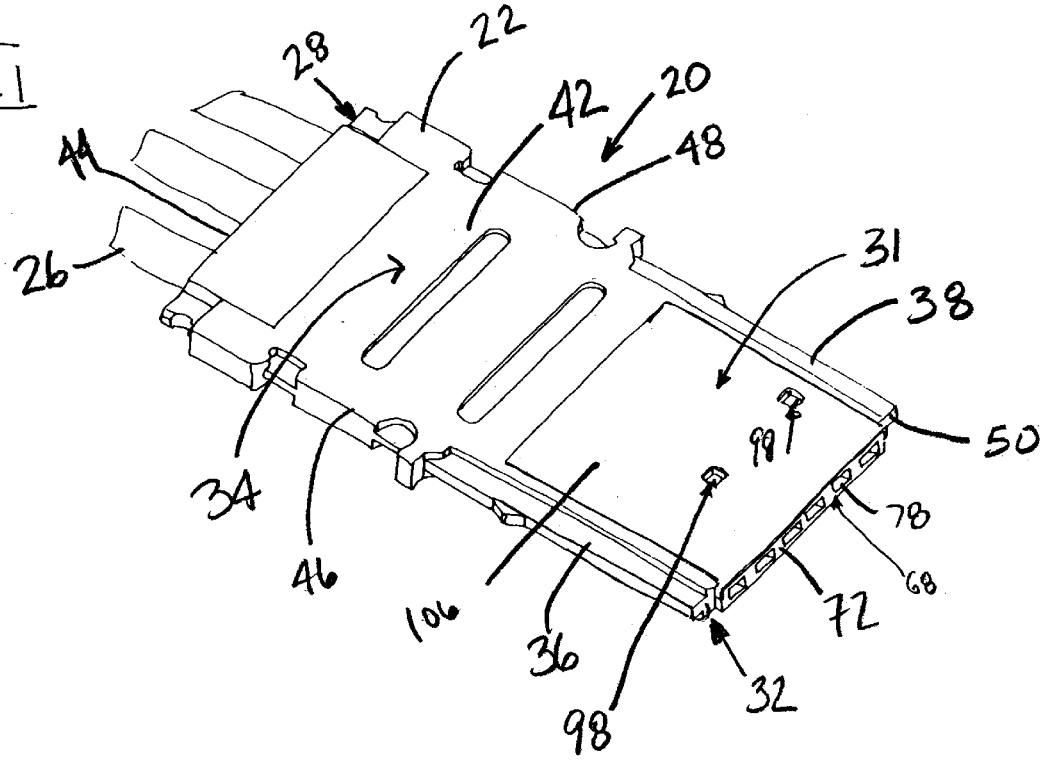
FIG. 1 is a perspective view of a wafer connector with a grounding shield constructed in accordance with the principles of the present invention.
Figure 5:
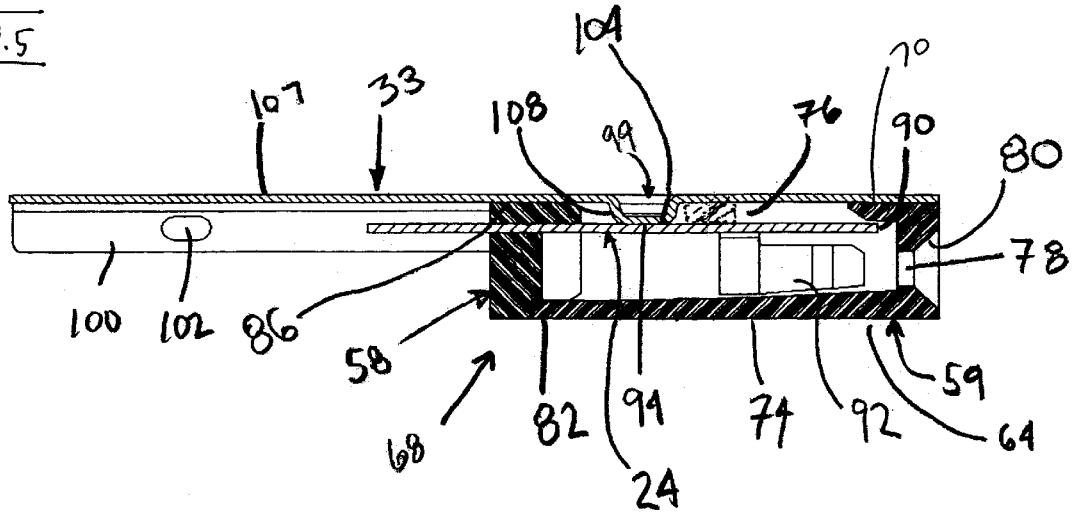
FIG. 5 is a partial, longitudinal cross-sectional view of the grounding shield, insert and terminal array of the connector of FIG. 7.

FIG. 1 illustrates an electrical connector element, or module 20, which has a relatively thin profile. Hence the name "wafer" connector has been commonly applied to such connectors in the art. The connector module 20, as is known in the art, has a housing 22 formed from an electrically insulative material which houses a plurality of conductive terminals 24. (FIG. 5.) These terminals 24 extend through the connector housing 22 in order to provide conductive paths between individual wires or cables 26, that are disposed along a rear end 28 of the housing 22, and the front end 32 of the housing 22 that is adapted for insertion into an opposing backplane-style connector, such as a pin header (not shown) that includes a plurality of conductive pins arranged in rows between two sidewalls.

The front end 32 of the connector 20 includes a plurality of pin-receiving passages 78 that are aligned with each internal terminal 24 of the connector and which permit the entrance of the pins of the opposing backplane connector to enter during engagement of the connector 20 and the backplane connector. The wires 26 that are terminated to connectors of the present invention typically include coaxial wires or pairs of wires that are surrounded by a grounding shield. In either situation both signal conductors and ground conductors enter the connector housing for termination. In order to maintain the ground paths associated with these wires, the connectors 20 are provided with a grounding shield 31 that extends near the front end 32 of the connector and which covers a portion of the connector housing 22 as shown in FIG. 1. The grounding shield 31, in order to maintain the appropriate grounding paths has to make contact with the terminals 24. In the prior art, spring legs or fingers have been stamped into the shield in a manner so that they extend well into slots for receiving the pins of an opposing connector. This construction causes the difficulties mentioned above. The present invention is directed to a connector construction that avoids such shortcomings.

Figure 3:
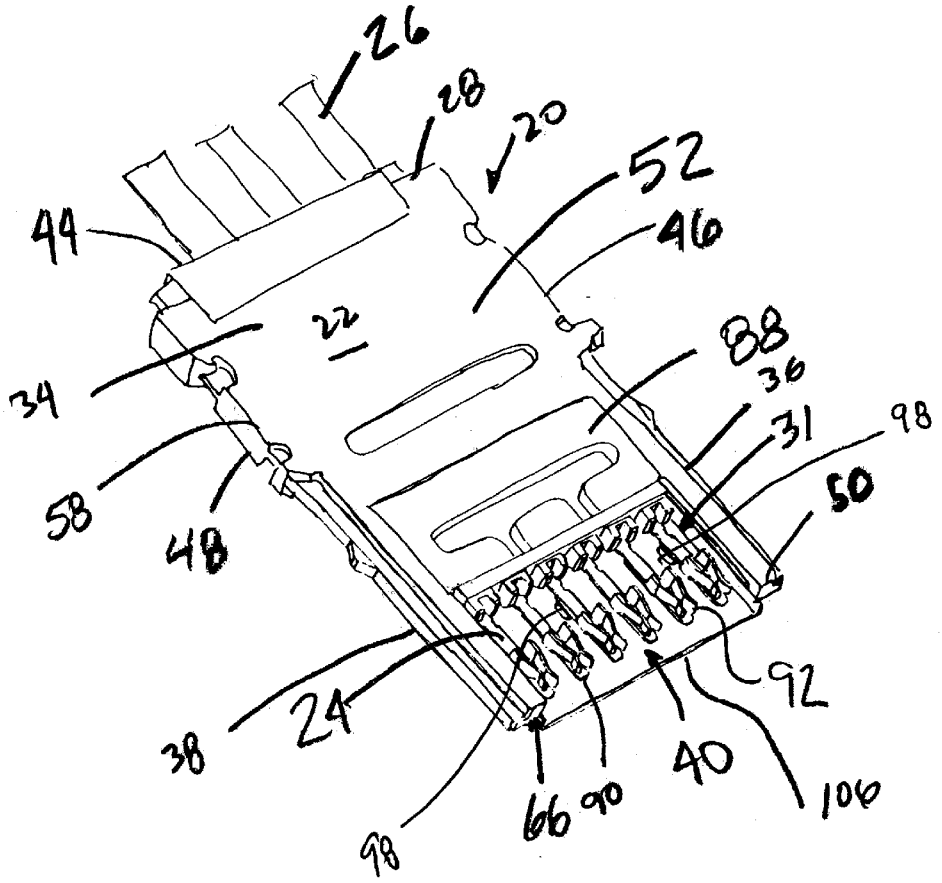
FIG. 3 is a perspective view of the connector of FIG. 2 with the insert removed for clarity and illustrating the terminal array of the connector.

The connector housing 22 includes a body portion 34 and two leg, or sidewall portions 36, 38 that extend away from the housing body portion 34 toward the forward end 32 of the connector 20 for a preselected extent. These legs 36, 38 and the body portion 34, cooperatively define a space, or receptacle 40 in the connector housing 22. This receptacle houses a plurality of conductive terminals 24 as illustrated. The connector housing body portion 34 may be considered as having a plurality of faces formed by outer surfaces thereof. A top surface 42 (with the term "top" merely describing the orientation of the connector 20 with respect to the grounding shield 31 as shown in the Figures) of the housing body portion 34 is the uppermost surface of the connector housing 22 and which may be considered as extending between the rear edge 28 of the connector 20, the front ends 50 of each connector housing leg 36, 38 and between two laterally opposed side edges 46, 48 of the connector housing. Likewise, the connector housing 22 has a "bottom" surface 52 which is best shown in FIG. 3, and which also extends between the rear edge 28, leg front ends 50 and the side edges 36 and 38.

Figure 2:
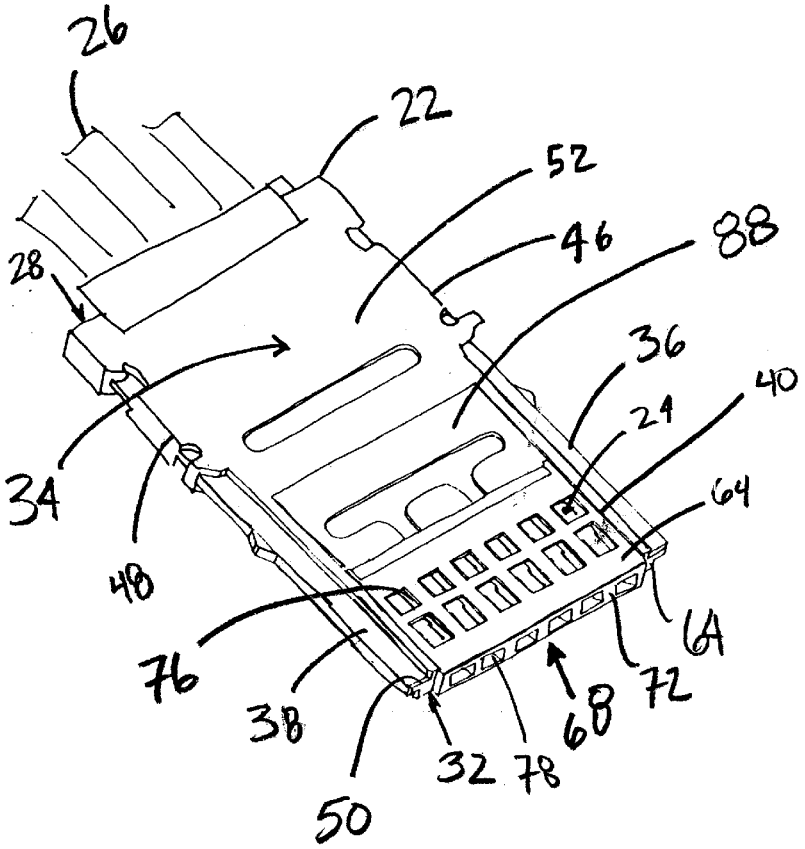
FIG. 2 is a perspective view of the underside of the wafer connector of FIG. 1, illustrating an insert used with the connector.

FIG. 2 illustrates the connector housing 22 with the grounding shield 31 removed and prior to its installation. The receptacle 40 contains a two-part insulative (preferably dielectric) insert 68. The two-part construction of the insert 68 (as used in the second embodiment of the invention) is best illustrated in FIG. 5. The insert 68 includes what may be considered as a header portion 58 that holds the terminals 24 in place, and a portion 59 that supports the terminals 24. The insert 68 includes opposing top and bottom surfaces 70 and 64, respectively, and a front end 72. Generally, the top surface 70 of the insert 68 will extend generally in the same plane as the connector housing top face 42.

Figure 4:
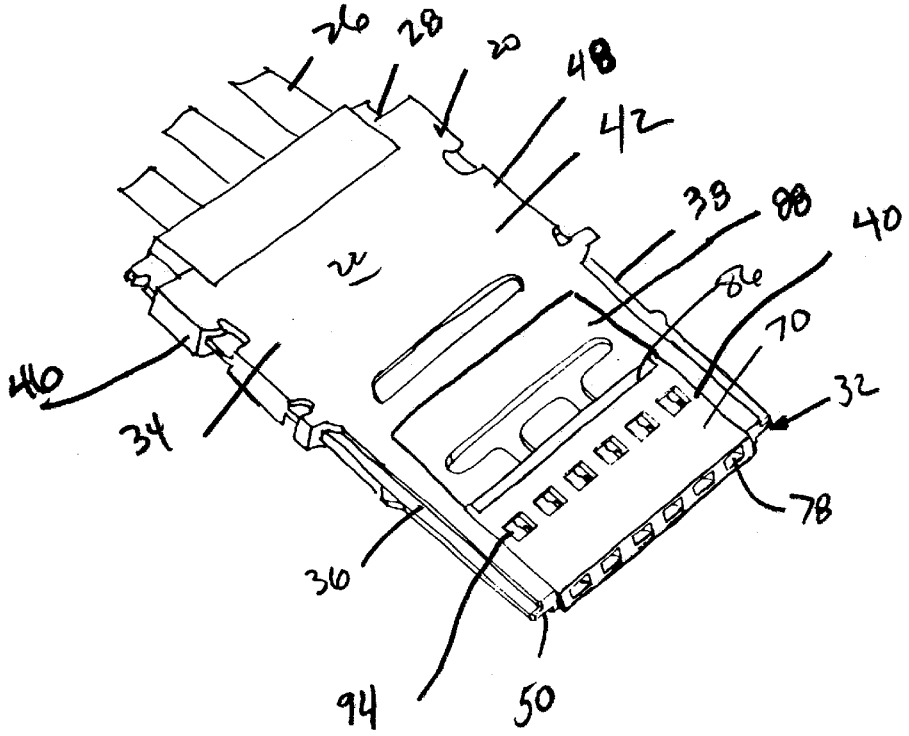
FIG. 4 is a perspective view of the connector of FIG. 1, with the grounding shield removed to illustrate the insert in place therein and covering a portion of the connector terminals.

A plurality of apertures 76 may be provided in either of the surfaces 70, 64 of the insert 68 in alignment with each terminal 24. The apertures 76 may be provided in pairs as shown in FIG. 2, or as individual apertures that are arranged in a single row as shown in FIG. 4. It is desirable that the apertures 76 provide a clear and unobstructed path to their corresponding terminals 24. Providing an entire row of apertures 76 in correspondence to the number of terminals 24 eliminates the need for custom manufacturing of the inserts 68 and facilitates attachment of the grounding shield 31 in proper contact with the preselected terminals 24.

As best shown in FIGS. 2 and 4–6, the insert front end surface 72 includes a plurality of openings 78 corresponding in number and position to the terminals 24. Pin contacts (not shown), as are known in the art to be commonly disposed in a high density formation pin header, pass through each opening 78 and are adapted to engage contacts 92 of every terminal 24. Electrical connections can be established with every available interconnection position in an extremely high density fashion, rather than the pre-selected electrical connection proposed in the prior art. A lead-in surface 80 may be provided with each opening 78 in order to assist the insertion of an opposing conductive pin (not shown). The openings 78 may take any configuration or shape in order to achieve their function.

Figure 6:
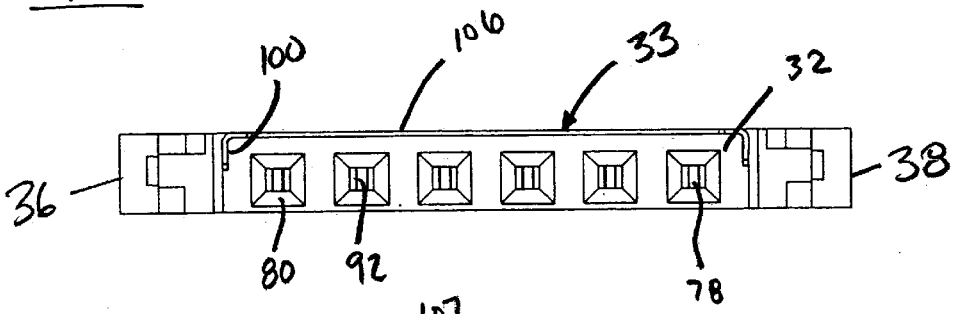
FIG. 6 is a front end view of the connector of FIG. 1.

The insert bottom surface 64, as best shown in FIGS. 5 and 6, may also have a generally planar configuration similar to the insert's top surface 70. The bottom surface 64 of the insert will serve to define at least a portion of the bottom face 52 of the connector housing 22. The insert support portion rear end 82 preferably abuts the insert terminal header portion 58 when the insert 68 is completely installed, thus substantially filling the receptacle 40 between the connector housing legs 36 and 38. In assembly, the terminal header 58 may have the terminals 24 insert molded thereinto for ease of construction and the remainder of the housing 22 subsequently overmolded thereto, with the support portion 59 being added either prior to or after the overmolding. The grounding shield 31 is subsequently attached to the connector 20 and it is partially supported by both of the upper surfaces 70 of the insert header 58 and the insert support 59.

As seen in FIG. 2, a recess 88 is formed in the top face 42 of the connector housing 22 so that when the grounding shield 31 is installed, it may lie substantially coplanar with the top surface 42 of the connector housing body portion 34. FIG. 3 illustrates the module 20 with the bottom face 52 shown on the top of the connector 20 turned up and prior to installation of the insert 68. The plurality of terminals 24 are shown preferably extending from the header 58 toward the front end 32 of the connector housing 22. Each terminal 24 may include a pair of opposed, curvilinear blade contacts 92 near their ends 90 that are adapted to engage pin contacts (not shown) after they are inserted through the pin-receiving openings 78 of the connector 20. Positive electrical connection is thereby made so that transmission of electrical signals may be effected from the cables 26 to the pins of the opposing connector. The terminals 24 further each may have a body portion 94 with a flat, upper surface 96 in opposition to the apertures 76 of the insert 68. These body portions are also aligned with selected depressions or dishes 98 that are drawn, or otherwise formed in the grounding shield 31 as described in detail below. In FIGS. 1–4, two such depressions 98 are illustrated, but more may be provided in correspondence with selected grounding terminals 24.

Figure 7:
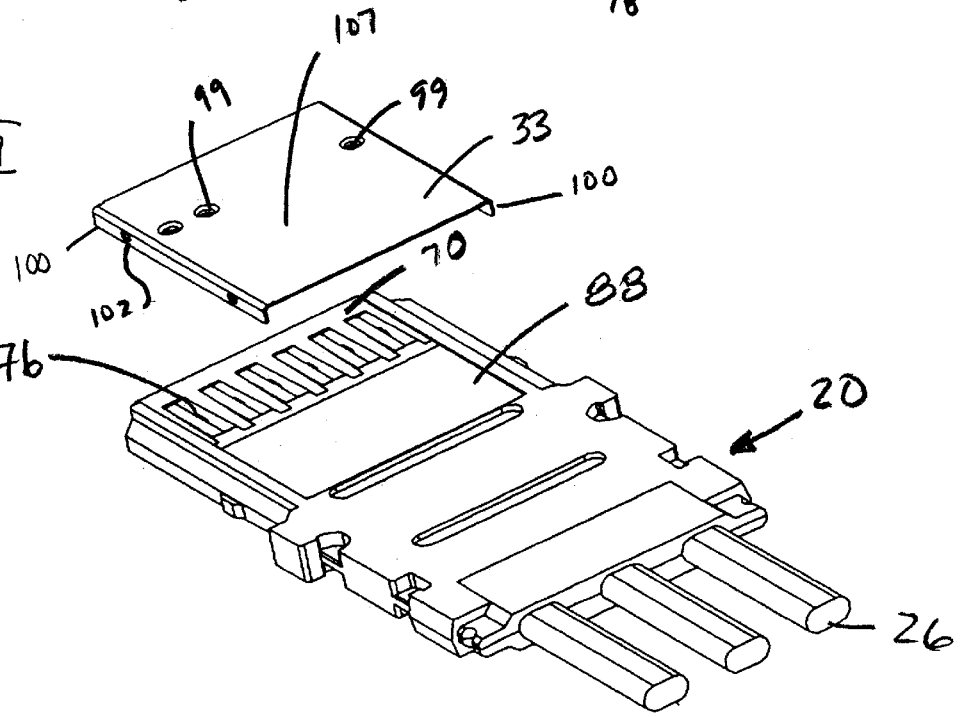
FIG. 7 is a partially exploded view of an alternative embodiment of a connector constructed in accordance with the principles of the present invention.

FIG. 5 illustrates the grounding shield 33 of FIG. 7 with its depressions 98 aligned in opposition to and contacting a terminal 24, and specifically its body portion 94. The grounding shield 33 takes a substantially planar shape with a pair of laterally opposed, depending legs 100 which may include an engagement member, such as the detents 102 illustrated in order to facilitate mounting and retention of the grounding shield 33 to the connector module 20. The grounding shield 33 may be formed or shaped from any suitable conductive material and the depression 98 is formed in a manner so as to preferably define a distinct contact portion 104 that opposes and contacts a preselected opposing terminal 24. The contact portion 104 may take any shape, however, it is preferable that it take a planar shape that extends in a different and parallel plane than the plane in which the cover portion 106 of the grounding shield 33 extends. Each therefore lies in a separate and distinct plane, and because the depression is drawn, there is a continuous extent 108 of conductive material that surrounds the contact portion 104 and connects it with the grounding shield cover portion 106. This extent 108 extends around the entire perimeter of the depression to thereby differentiate it from stamped ground contacts of the prior art. The grounding shield cover portion 106 may defines a portion of the top surface 42 of the connector housing 22.

After the grounding shield 33 has been installed, the depressions 98 extend at pre-selected positions through selected apertures 76 formed in the insert 68 so that the depression contact portions 104 abuttingly contact their corresponding opposing terminals 24. The contact portions 104 fastened to the terminals 24 in what may be considered an integral and electrically conductive manner, such as by resistance welding, a conductive adhesive or a pin or rivet connection.

FIG. 7 illustrates an alternative embodiment of the invention where the grounding shield 33 has been modified with three, circular depressions 99 formed therein. The number of depressions 99 used with the grounding shield 33 which can be provided on the grounding shield cover portion 107 will depend on how many of the terminals 24 of the connector 20 need to be grounded. This number may be equal to or less than the total number of terminals 24. Any shape may be used to form the depressions, so long as the contact portion 104 thereof is continuously connected to the grounding shield 33 and in an abutting relationship with the desired terminal 24.

While the particular preferred embodiments of the present invention have been shown and described, it will be obvious to those skilled in the art that changes and modifications may be made without departing from the teachings of the invention.

We claim:

1. An electrical connector module comprising:

an insulative connector housing including a body portion, a plurality of wires extending into the housing along one end thereof;

a plurality of conductive terminals disposed within said connector housing and extending longitudinally through said connector housing between said wires and a front end of said connector, each terminal having a contact portion for receiving an opposing terminal of an opposing connector, the contact portions of said terminals being disposed in side-by-side order along said connector front end, each of said terminals further having a body portion disposed between said contact portion and said wires, said connector housing having at least one aperture formed therein in alignment with a preselected terminal; and, a grounding shield supported on a preselected surface of said connector housing, the grounding shield at least partially defining a portion of a top face of said connector module, said grounding shield having a least one ground contact formed therein, the ground contact being formed in said grounding shield by drawing, the ground contact including at least one depression aligned with said connector housing aperture, said depression extending away from said grounding shield through said connector housing aperture and into abutting contact with said preselected terminal.

2. The connector module of claim 1, wherein said grounding shield ground contact is integrally fastened to said preselected terminal.

3. The connector module of claim 2, wherein said grounding shield ground contact is resistance welded to said preselected terminal.

4. The module of claim 1, wherein said connector housing includes a receptacle partially communicating with said connector housing front end, and said connector module further includes an insulative insert portion that holds said terminals in place in a preselected orientation within said connector housing receptacle, said insert including at least one aperture formed therein in alignment with said preselected terminal so that said depression extends from said grounding shield through said aperture into contact with said preselected terminal.

5. The module of claim 4, wherein said grounding shield has a cover portion supported in part by said insert.

6. The module of claim 1, wherein said depression has a circular configuration.

7. The module of claim 1, wherein said depression has a square configuration.

8. An electrical connector module comprising:

an electrically insulative U-shaped housing having a body portion and a pair of parallel legs extending from opposing longitudinal edges of said housing body portion, the legs defining a receptacle of said connector housing therebetween;

a plurality of conductive terminals supported by said housing body portion and disposed within the housing receptacle between said legs, each said terminal having at least a body portion and a contact portion, the contact portions of said terminals being disposed proximate to a front end of said connector housing; and, a grounding shield supported in part on said connector housing, the grounding shield partially overlying said terminals and said receptacle, said grounding shield having a cover portion that extends in a first plane, said grounding shield being electrically connected to at least one of said terminal by way of a dish formed in said grounding shield cover portion, the dish having a contact portion spaced apart from said grounding shield cover portion and disposed in a second plane, different from said first plane, said dish being disposed in opposition to said one terminal and extending through said receptacle into electrical contact with said one terminal to thereby electrically connect said grounding shield to said one terminal.

9. The connector module of claim 8, wherein said dish is integrally connected to said one terminal at said body portion thereof.

10. The connector module of claim 9, wherein said dish portion is connected to said one terminal by resistance welding.

11. The connector module of claim 8, further including an insulative insert disposed in said connector housing receptacle between said connector housing legs, the insert having a body portion that partially encompasses said terminals and said insert including at least one aperture formed therein in alignment with said one terminal.

12. The connector module of claim 11, wherein said dish extends through said insert aperture and into contact with said one terminal.

13. The connector module of claim 8, wherein said grounding shield cover portion forms an exterior surface of said connector.

14. An electrical connector module comprising:

a connector housing having a plurality of distinct faces defined by a plurality of edges;

a plurality of conductive terminals disposed within said housing, each said terminal having a defined body portion; and, a grounding shield disposed upon said connector housing, the grounding shield having a cover portion extending in a first plane that overlies said terminals, said grounding shield further including at least one contact member drawn therein in the form of a depression that extends away from said grounding shield cover portion, the depression terminating in a terminal contact portion that is disposed in a second plane, spaced apart from said first plane, said depression electrically contacting one of said terminals to effect an electrical connection between said grounding shield and said one terminal.

15. The connector module of claim 14, wherein said grounding shield is partially supported on said connector housing by an insulative insert.

16. The connector module of claim 15, wherein said insert includes at least one apertures formed therein and in alignment with said depression such that said depression extends through said insert aperture into contact with said terminal.

17. The connector module of claim 14, wherein said depression terminal contact portion and said one terminal contact surface and at least one of said terminals are integrally joined together by resistance welding.

18. The connector module of claim 14, wherein said depression has a circular configuration.

19. The connector module of claim 14, wherein said depression has a square configuration.

* * * * *